United States Patent [19]

Yoshinaga et al.

[11] 4,348,288

[45] Sep. 7, 1982

[54] PROCESS FOR DESALTING FUEL OIL

[75] Inventors: Shoji Yoshinaga; Hirosige Kawano; Matsuzo Todo; Tosihiko Takahasi; Kiyoshi Fujiwara; Yukio Inoue, all of Kudamatsu, Japan

[73] Assignee: Hitachi, Ltd., Tokyo, Japan

[21] Appl. No.: 79,154

[22] Filed: Sep. 26, 1979

[30] Foreign Application Priority Data

| | | | |
|---|---|---|---|
| Sep. 27, 1978 | [JP] | Japan | 53-117852 |
| Oct. 27, 1978 | [JP] | Japan | 53-131514 |
| Oct. 27, 1978 | [JP] | Japan | 53-131519 |
| Jan. 22, 1979 | [JP] | Japan | 54-4807 |

[51] Int. Cl.[3] ..... B01D 17/04

[52] U.S. Cl. ..... 210/708; 210/787; 208/15; 252/328

[58] Field of Search ..... 210/43, 59, 71, 73 W, 210/708, 749, 765, 772, 781, 787; 252/328, 346–349; 208/15

[56] References Cited

U.S. PATENT DOCUMENTS

| | | | |
|---|---|---|---|
| 2,698,303 | 12/1954 | Blair et al. | 252/349 |
| 2,830,957 | 4/1958 | Rhodes | 252/328 |
| 3,265,212 | 8/1966 | Bonsall | 210/73 W |
| 4,123,357 | 10/1978 | Clements | 210/71 |

OTHER PUBLICATIONS

Buckland et al., "Modified Residual Fuel for Gas Turbines", Transaction of the ASME, Nov. 1955, pp. 1199–1209.

*Primary Examiner*—Thomas G. Wyse

*Attorney, Agent, or Firm*—Craig and Antonelli

[57] ABSTRACT

Fuel oil containing sodium salt, potassium salt and solid matters is purified by separating the fuel oil into fuel oil and sludges by a centrifugal separating means, thereby removing the sludges from the fuel oil, and mixing the fuel oil freed from the sludges with water, and separating the resulting liquid mixture into fuel oil and water. Removal of the salts and the solid matters from the fuel oil can be attained at the same time very effectively with a reduced frequency of cleaning a filter or by omitting the use of the filter, with or without using an emulsion breaker.

14 Claims, 15 Drawing Figures

PROCESS FOR DESALTING FUEL OIL

This invention relates to a process for desalting fuel oil, and particularly to a process for washing and desalting fuel oil for a gas turbine by utilizing a centrifugal force.

Gas turbines are widely utilized in many uses such as power generation, etc., because a large power can be generated in a small scale apparatus. Since the gas turbines are in such a structure that a high temperature gas obtained by combustion of fuel oil is injected onto turbine blades to generate a power, a corrosion or erosion problem due to the presence of impurities contained in the fuel gas appears. The impurities causing such as problem are varied, but especially a sodium salt or a potassium salt is a main cause for the corrosion, and it is necessary to remove these salts from the fuel oil, that is, to conduct desalting. In other words, it is necessary to reduce the sodium salt and potassium salt in the fuel oil to less than a few ppm, desirably less than 1 ppm. On the other hand, the main cause for the erosion is solid matters such as sand grains, etc. and these must be also removed.

The solid matters contained in fuel oil can be removed by a filter. That is, sodium salt or potassium salt is combined mainly with chlorine as sodium chloride (NaCl) or potassium chloride (KCl), and is dissolved in a very small amount of water present in fuel oil or exists in fuel oil as fine solids in the form of sodium chloride or potassium chloride. Therefore, it seems that the sodium salt or potassium salt can be simply removed by washing fuel oil with water to transfer the sodium salt or potassium salt into water and separating the water from the fuel oil owing to the fact that these salts are soluble in water. However, it is well known that, when fuel oil and water are mixed together by stirring, an emulsion is formed, and the fuel oil and water can be no more separated from each other. Thus, usually a chemical for preventing formation of an emulsion (which will be hereinafter referred to as an emulsion breaker) is added to fuel oil, and then the fuel oil and water are separated from each other by utilizing a centrifugal force or an electrostatic force.

The ordinary centrifugal separator is made up from a rotor rotating at a high speed, an outer peripheral wall surrounding the rotor, an inlet pipe for introducing a liquid mixture of fuel oil and water, outlet pipes each withdrawing the water and the fuel oil from the rotor, and a sludge discharge outlet provided at the outer peripheral wall. When the liquid mixture is introduced into the rotor under rotation, the liquid mixture is separated into the fuel oil, water and sludge under an action of strong centrifugal force, and the fuel oil and the water are discharged through the respective outlet pipes, whereas the sludge with a poor flowability is discharged from the discharge outlet provided at the outer peripheral wall.

In this manner, the desalting by means of a centrifugal separator is made possible only by a combination of washing by mixing of fuel oil with water and separation of the liquid mixture of fuel oil and water into each of them by addition of the emulsion breaker, that is, by a combination of washing by mixing-separation (A. A. Pitrolo et al: Heavy Fuel Treatment System; Gas Turbine Reference Library, GER-2484A, published by General Electric).

The prior art will be described, referring to the accompanying drawings.

Figure 1:
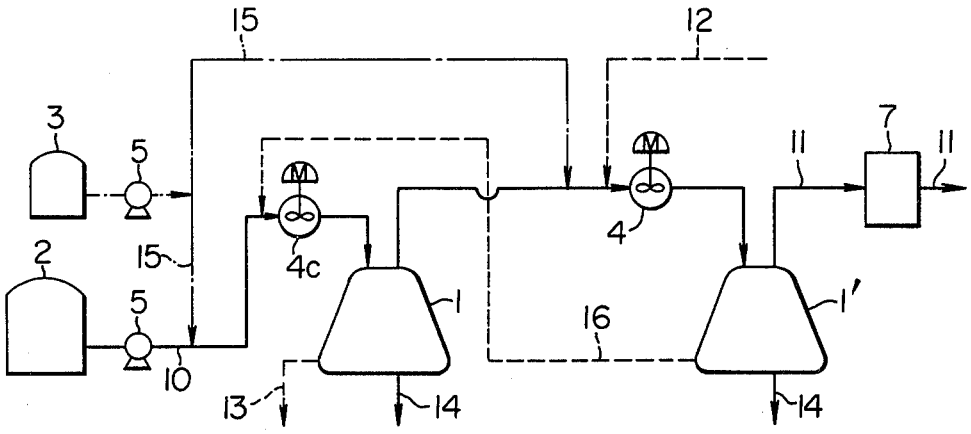
FIG. 1 is a block diagram showing a prior art process for desalting fuel oil by washing.

In FIG. 1, numeral 1 is a first centrifugal separator, 1' is a second centrifugal separator, 2 is a fuel oil tank, 3 is an emulsion breaker tank, 4C and 4 are mixers, 5 is pumps, 7 is a filter, 10 is a fuel oil supply line, 11 is a washed oil supply line, 12 is a pure water supply line, 13 is a waste water discharge line, 14 is sludge discharge lines, 15 is an emulsion breaker supply line, and 16 is a washing water supply line.

In such a structure as described above, large solid particles are removed in the fuel oil tank 2 by precipitation, etc. Raw fuel oil withdrawn from the fuel oil tank 2 by means of the pump 5 is admixed with the emulsion breaker and the washing water, and they are mixed by the mixer 4C to sufficiently wash the fuel oil. The fuel oil washed by mixing by the mixer 4C is introduced into the first centrifugal separator 1, where the raw fuel oil mixture is separated into fuel oil, water, and sludge under the action of a centrifugal force. The water is discharged therefrom through the discharge line 13, whereas the sludge is withdrawn therefrom through the discharge line 14, and they are led to the respective successive steps.

The fuel oil freed from the water and the sludge is further admixed with the emulsion breaker and washing water and thoroughly mixed by means of the mixer 4 to effect washing. Then, the resulting fuel oil mixture is introduced into the second centrifugal separator 1', where the mixture is separated into fuel oil, water and sludge, and the fuel oil is purified thereby and withdrawn through a supply line. In order to remove solid matters contained in the fuel oil after the washing and separation, the fuel oil is passed through the filter 7, and then stored in a tank as a gas turbine fuel.

As described above, the raw fuel oil is desalted and purified by repetitions of washing through mixing with water and then by separation by means of a centrifugal separator, that is, repetitions of the so-called washing by mixing-separation. As the water for washing, water having a smaller content of sodium salt and potassium salt supplied from the supply line 12 is used at that time. The water after the washing contains a larger amount of sodium salt and potassium salt, and further contains other impurities contained in the fuel oil. The water after the washing can be reused as pure washing water after the water has been subjected to a treatment to remove these impurities from it, but is sometimes discarded as waste water from an economical viewpoint. The amount of washing water must be enough to effect a sufficient washing of fuel oil by mixing and stirring, and usually is 5–10% by volume on the basis of fuel oil.

According to the prior art process, its principal object is a desalting, where separation of washing water from washed fuel oil is carried out by addition of an emulsion breaker, thereby purifying the fuel oil.

On the other hand, fine solid matters are contained in the purified fuel oil in the prior art process, and thus are removed by the filter 7, and consequently the filter 7 is often clogged by the fine solid matters, and must be more often cleaned. This is a disadvantage of the prior art process.

Since the desalting of fuel oil is to remove the sodium salt and potassium salt readily soluble in water, fuel oil must be washed with water, and the introduced washing water must be separated from the washed fuel oil. However, a mixing of fuel oil with water produces an emulsion, and separation of an emulsion into water and fuel oil becomes impossible. Thus, usually an emulsion breaker is introduced therein to separate the emulsion into water and fuel oil.

On the other hand, raw fuel oil contains sludges, and as a result of various tests and studies of the sludges, it has been found that the sludges depend upon the kind of fuel oil, and the sludges are assemblies of fine water droplets having diameters of less than 10–50 μm, and generally the fine water droplets settle down by leaving them standing still owing to the specific gravity of fuel oil being smaller than that of water, and a layer of a group of water droplets and fuel oil filled among the water droplets is formed at the bottom. This is the so-called sludges. Therefore, the sludges can be obtained in the same manner as in the ordinary oil, that is, by introducing water into fuel oil and sufficiently mixing of the fuel oil with water, thereby making an emulsion and leaving the emulsion standing still or centrifuging it. The resulting sludge layer contains a solid wax and water droplets in addition to solid matters such as sand, iron grains, etc., and is a highly viscous layer, and the water droplets in the sludges contain the sodium salt and potassium salt in solution. These water droplets will not be destructed by a strong centrifugal force and will never turn into a substantial water layer. Removal of the sludges means the removal of solid matters and water droplets, that is, the removal of sodium salt and potassium salt.

That is, many sludges are formed at the bottom of a fuel oil tank because a standstill state prevails in the fuel oil tank. In that case, solid matters such as sand, etc. have higher specific gravities than that of fuel oil, and thus settle down and enter into the sludge layer. On the other hand, when fuel oil containing the sludges is mixed and stirred, the sludges are not uniformly dispersed down to a water droplet state, but are dispersed as agglomerates of sludges. Furthermore, the viscosity of sludge is high. The solid matters are surrounded by the highly viscous sludges, and cannot be discharged from the sludges by stirring with the ordinary intensity. Therefore, removal of solid matters can be carried out by adding water to fuel oil and stirring them to make sludges, and including the solid matters from the fuel oil into the sludges.

That is, when a small amount of water is added to fuel oil and mixed, the water is dispersed into the fuel oil as water droplets. When a strong centrifugal force is applied to the water-dispersed oil, an oil layer and a layer of assemblies of water droplets are formed, but no water layer is substantially formed. The layer of assemblies of water droplets is the so-called sludges. Therefore, sodium salt, potassium salt and solid matters can be removed also by adding water to fuel oil and mixing them, thereby collecting solid salts such as sodium salt, etc. and droplets containing sodium salt, etc. in solution from the fuel oil into the added water, making a water droplet layer, that is, sludges, by application of a centrifugal force thereto, and removing the sludges from the fuel oil. The viscosity of sludges is high, as described above, and the solid matters in the sludges can never been separated from the sludges even under an action of a high centrifugal force.

However, when an emulsion breaker is added thereto, most of the sludges are destructed, and a water layer is formed. Thus, the solid matters once included in the sludges are discharged into the oil layer owing to the destruction of the sludge due to the addition of the emulsion breaker.

As a result of tests conducted by the present inventors, using a centrifugal separator having a handling capacity of 3 l/min. and a speed of 4,000 rpm and fuel oil having a viscosity of 3.5 centistokes at 50° C., it has been found that (1) when an emulsion breaker is added thereto, a sludge discharge amount is reduced, but about 40% of solid matters in the raw fuel oil is retained in the discharged fuel oil from the centrifugal separator, (2) when no emulsion breaker is added thereto, the sludge discharge amount is increased, but no solid matters are observed in the discharged fuel oil from the centrifugal separator, (3) when 0.5% by volume of water is added to the discharged fuel oil in said case (1), and then fuel oil is stirred and centrifuged, the solid matters are observed in the discharged oil, etc., and the foregoing observation has been experimentally supported.

It has been evident from the results of these tests and studies that the prior art process is not satisfactory for the removal of solid matters, and consequently a frequency of cleaning the filter is increased.

The present invention provides a process for desalting fuel oil by repetitions of a combination of washing of fuel oil with water and separation by centrifugal force. Fuel oil must be handled at least at a rate of a few 10 $m^3$/hr, and thus the desalting operation is conducted as a continuous operation. However, in the continuous operation, some amount of water is sometimes entrained in the fuel oil in the separating step, and sodium salt, etc. are dissolved in such water, and thus the desalting is not satisfactory only by one repetition of a combination of washing and separation, and thus such a combination of washing and separation is carried out in two or more repetitions. Thus, in the desalting process according to the present invention, a combination of washing and separation can be conducted in at least two repetitions. However, when a centrifugal separator or similar separating machine is used as a centrifugal means, it is a high speed rotating expensive machine, and at least two repetitions of such combination require at least two centrifugal machines, and thus the apparatus cost will be much increased. After the solid matters have been removed as sludges from the fuel oil by a centrifugal means, water can be removed from the fuel oil by means of an oil-water separating element. The oil-water separating element is cheaper than the centrifugal separator, and thus the whole desalting can be made in a cheaper apparatus.

That is, an oil-water separating element can be used according to one embodiment of the present invention.

In various machines and apparatuses, water in oil generally causes to corrode materials. For example, aviation fuel oil is sufficiently purified by distillation, etc., but is removed of water by an oil-water separating element for preventing corrosion by water. The oil-water separating element is a device comprised of one or more layers of synthetic fiber, natural fiber, glass fiber, etc. in a cloth state or a rope state, and when fuel oil is passed through the oil-water separating element, water droplets in water are joined together to form water droplets of larger size, and the water and fuel oil are separated from each other owing to a difference in specific gravities in the gravitational field.

The oil-water separating element in the present invention is directed to that having such structure as described above. In order to fully conduct a separating performance of the oil-water separating element, openings between the fibers through which the fuel oil passes are as small as a few μm to a few tens μm. On the other hand, many solid matters having sizes of a few μm to a few tens μm are contained in the fuel oil to be handled in the present invention, and these solid matters cause clogging, interrupting the operation. It is difficult to remove the fine particles deposited in the fine openings to regenerate the oil-water separating element, and thus it has been so far regarded as impossible to conduct separation of water from the fuel oil by an oil-water separating element.

According to one embodiment of the present invention, effective removal of fine solid matters is made possible by adding washing water or not to fuel oil according to the amount of water in the fuel oil without adding any emulsion breaker to the fuel oil to be introduced into a centrifugal separating means, thereby making sludges of water droplets sufficiently including the fine solid matters in the centrifugal separating means, and after the removal of the fine solid matters from fuel oil by the centrifugal separating means, water is removed from the fuel oil by an oil-water separating element. Since in the oil-water separating element, water is removed from a liquid mixture of fuel oil and water substantially freed from the fine solid matters, clogging of the openings of the oil-water separating means is reduced, making the continued operation possible.

According to another embodiment of the present invention, desalting and removal of solid matters are carried out in a plurality of repetitions of the combination of washing by mixing-separation without adding an emulsion breaker to destruct the sludges to at least one repetition thereof, thereby considerably reducing a frequency of cleaning the filter, or rather unnecessitating the use of the filter.

An object of the present invention is to overcome the foregoing disadvantages of the prior art by collecting the fine solid matters as a cause for clogging a filter into sludges to be separated and discharged by a centrifugal separating means, and discharging the fine solid matters together with the sludges, thereby removing the fine solid matters from the fuel oil.

Another object of the present invention is to remove sodium salt, potassium salt, and fine solid matters from fuel oil by adding water to fuel oil, thereby forming sludges, and removing the sludges from the fuel oil by a centrifugal separating means.

Modes of embodiments of the present invention will be described in detail, referring to the drawings.

Figure 2:
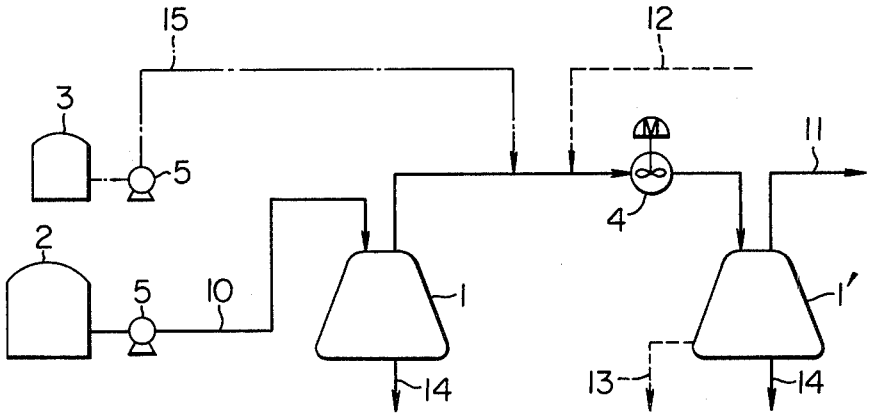
FIGS. 2–11 are block diagrams showing a process for desalting fuel oil according to the respective embodiments of the present invention.

In FIG. 2, a block diagram of one embodiment of the present invention is shown, where numerals are identical with those of FIG. 1, unless otherwise specifically mentioned.

Raw fuel oil flowing through supply line 10 is supplied to first centrifugal separator 1, where it is separated into sludge and fuel oil. The sludge is discharged through discharge line 14. The fuel oil withdrawn from the first centrifugal separator 1 is mixed with an emulsion breaker supplied through supply line 15, and pure water supplied through supply line 12, and stirred by mixer 4 to conduct mixing, stirring and washing. Then, the resulting liquid mixture is led to second centrifugal separator 1', where it is separated into fuel oil, sludge and water. The fuel oil flows through supply line 11 as washed fuel oil, and led to a fuel oil storage tank (not shown in the drawing). The water and the sludge are led to successive step through waste water discharge line 13 and sludge discharge line 14, respectively, and are to be treated there.

In the foregoing manner, sodium salt, potassium salt as well as the solid matters can be removed from the fuel oil.

In the foregoing embodiment, the sludge removal is carried out in the first centrifugal separator 1, that is, at the first step for the fuel oil stream. In other words, this can effectively reduce the amount of washing water in the second step and also can increase the desalting effect. As described before, the sodium salt and the potassium salt in the fuel oil are dissolved in water in the fuel oil or suspended as solid matters of sodium salt and potassium salt therein, and water is in the form of sludges, and the solid matters are included in the sludges. Thus, when the sludges are removed from the fuel oil, without adding an emulsion breaker to the fuel oil, in the first centrifugal separator 1, sludges containing a large amount of sodium salt and potassium salt, as well as the solid sodium salt and potassium salt can be removed.

According to the tests conducted by the present inventors, a desalting ratio of more than 90% was obtained only by the separation of sludges, though dependent upon the kind of fuel oil. In the second step, the reduced amount of sodium salt and potassium salt is removed, and thus the amount of washing water can be reduced. That is, the removal of sodium salt and potassium salt can be more readily carried out with a larger desalting effect owing to the removal of the reduced amount of sodium salt and potassium salt by washing.

In this manner, the present invention comprises a combination of a separating step of removing sludge from fuel oil and a step of washing by mixing-separation.

In FIG. 2, the centrifugal separator is examplified in the step of washing by mixing-separation, but a centrifugal extractor capable of conducting liquid-liquid extraction in a rotating rotor can be used in place of the centrifugal separator.

Figure 3:
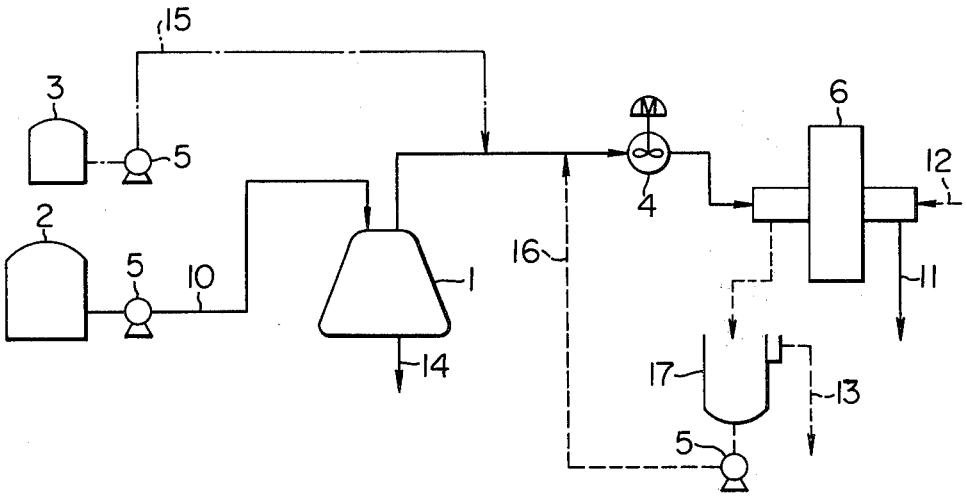

In FIG. 3, another embodiment of the present invention is shown, where a centrifugal extractor is used in the step of washing by mixing-separation. That is, numeral 6 is a centrifugal extractor, and 17 is a receptacle. The centrifugal extractor 6 is provided with two inlets and two outlets, and fuel oil and pure water are brought in counter-current contact in a centrifugal extractor. That is, the washing effect can be improved. As shown in FIG. 3, the centrifugal extractor 6 is provided in place of the second centrifugal separator 1' of FIG. 2, and a liquid mixture of fuel oil from the first centrifugal separator 1, washing water from supply line 16 and an emulsion breaker from supply line 15 is supplied to one of the inlets of the centrifugal extractor 6. Pure water from supply line 12 is supplied to another inlet of the centrifugal extractor 6. In the centrifugal extractor 6, fuel oil and water are separated under an action of strong centrifugal force, and the fuel oil is brought in counter-current contact with the pure water from the supply line 12, washed again, withdrawn as washed fuel oil from one of the outlet, and passed through supply line 11. On the other hand, water and the sludges are discharged from another outlet, and led to the receptacle 17. A portion of water and the sludges are discharged therefrom as waste water through discharge line 13 and led to successive step. Other remaining portion of water is passed through supply line 16 as washing water, and introduced into the fuel oil. In this manner, highly effective washing and desalting can be attained also in this embodiment.

Desalting and removal of solid matters are often not completed only by one washing-separation or by one separation, because the desalting operation is a continuous operation to continuously supply the fuel oil, and consequently a portion of water droplets containing sodium salt and potassium salt, and a portion of sludges as well as a portion of solid matters are entrained in the fuel oil stream. Thus, two or more runs of washing by mixing-separation are desirable. Such runs are possible by arranging a plurality of centrifugal separators or centrifugal extractors in series.

Figure 4:
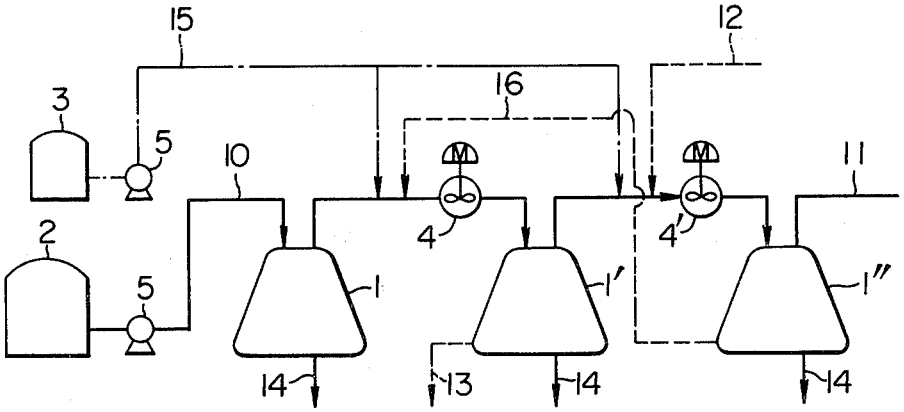

FIG. 4 shows one embodiment of a plurality of runs of washing by mixing-separation, wherein numeral 1'' is a third centrifugal separator, which is provided together with a mixer 4' after the second centrifugal separator 1' of FIG. 2. In such a structure as shown in FIG. 4, one more combination of washing by mixing-separation can increase the desalting effect.

For the foregoing reasons it is obvious that the sludges in the fuel oil can be completely removed by increasing the number of centrifugal separators to which no emulsion breaker is added.

Usually, the raw fuel oil contains sludges, but sometimes not. In the latter case, water can be added to the fuel oil to make an emulsion, and then make sludges, and the solid matters can be made to be included in the sludges, and then removed.

Figure 5:
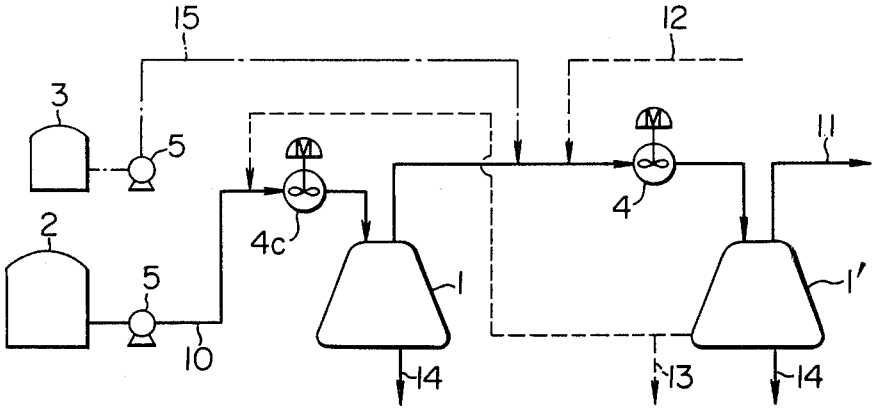

FIG. 5 shows other embodiment of the present invention, and a mixer 4C is provided before the first centrifugal separator 1 of FIG. 2, so that a portion or all of the waste water passing through the waste water discharge line 13 from the second centrifugal separator 1' can be supplied to the raw fuel oil before said mixer 4C. In such a structure as shown in FIG. 5, an emulsion is formed in the mixer 4C and when sludges are formed in the first centrifugal separator 1, the solid matters can be included in the fuel oil, whereby the solid matters can be removed from the fuel oil.

Figure 6:
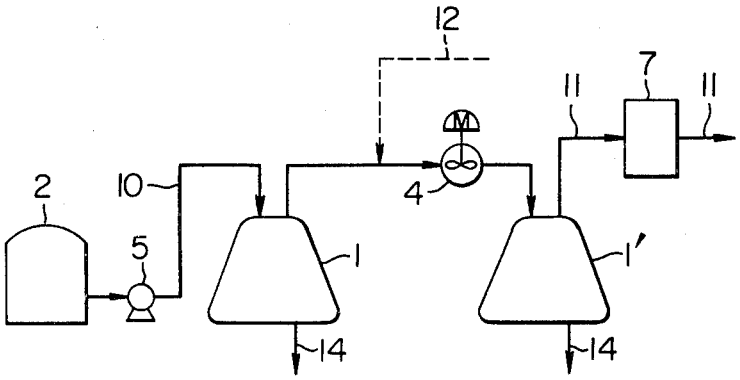

FIG. 6 shows further embodiment of the present invention, where the raw fuel oil from line 10 is passed through a first centrifugal separator 1 and then second centrifugal separator 1', and then through filter 7, and led to a successive step. In the first centrifugal separator 1, sludges contained in the raw fuel oil are removed. Thus, solid matters and most of sodium salt and potassium salt are removed therein. Since the fuel oil freed from the sludges contains a small amount of water droplets, as entrained in the fuel oil stream, the sodium salt and potassium salt are not completely removed. Pure water from supply line 12 is added to the fuel oil and dispersed into water droplets by stirring and mixing in mixer 4, and the water-dispersed fuel oil is introduced into the second centrifugal separator 1'. A layer of group of water droplets, that is, sludges, is formed in the introduced fuel oil by a centrifugal force. Washed fuel oil having a reduced content of the sodium salt and potassium salt can be obtained by removing the sludges. The pure water thus used can be removed from the fuel oil as included in the sludges, but some of pure water is entrained in the fuel oil stream. When a concentration of sodium salt and potassium salt is higher, the concentration thereof in the washed fuel oil is higher, and such is not preferable. Since about 1,000 ppm of water often remains in the washed fuel oil, it is desirable to use pure water having a concentration of sodium salt and potassium salt of 1,000 ppm at most.

In the foregoing manner, solid matters, sodium salt and potassium salt can be removed from the fuel oil without using the expensive emulsion breaker.

According to tests using 1.5% by volume of pure water on the basis of the fuel oil, raw fuel oil having a sodium concentration of 20 ppm is reduced to a concentration of 3 ppm at the outlet of the first centrifugal separator 1, and to a concentration of 0.5 ppm at the outlet of the second centrifugal separator 1', and no solid matters having sizes of more than 5 $\mu$m are not found in the resulting washed fuel oil. Water content of washed fuel oil is 1,000 ppm. The higher the ratio of pure water to be added to fuel oil, the larger the washing effect. When the ratio is not more than 2% by volume, a water content of the washed fuel oil is small and is kept substantially constant, but at more than 2%, the water content of the washed fuel oil is increased. Thus, the mixing ratio of pure water to fuel oil is preferably not more than 2% by volume.

The content of sodium salt and potassium salt contained in water droplets in the sludges in raw fuel oil is large, and the entrainment of water droplets of the sludges in the outlet fuel oil from the first centrifugal separator 1 is physically inevitable. Thus, the content of sodium salt and potassium salt in the fuel oil from the first centrifugal separator 1 is not sufficiently reduced, and at least one more centrifugal separator must be provided, and two or more centrifugal separators must be usually provided in the present invention.

The water content of the washed fuel oil must be further reduced in some cases in view of requirements in the successive step.

Figure 7:
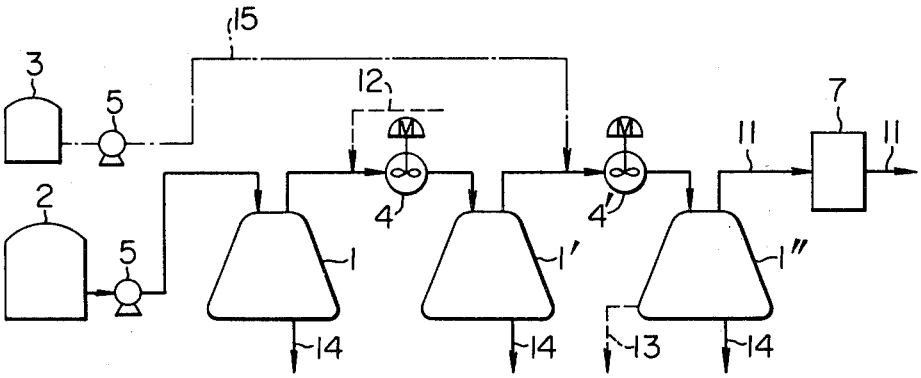

FIG. 7 shows still further embodiment of the present invention, where numeral 1'' is a third centrifugal separator, and the oil to be introduced into the third centrifugal separator 1'' is admixed with an emulsion breaker from supply line 15 and subjected to stirring and mixing in mixer 4'. According to such a structure as shown in FIG. 7, a small amount of water droplets contained in the washed fuel oil join together with the water droplets formed through destruction by the emulsion breaker, and formed into a water layer in the third centrifugal separator 1'', whereby separation of water-fuel oil can be attained, and also the water content of the washed fuel oil can be reduced.

Since the water content of the fuel oil entered into the third centrifugal separator 1'' is so small that the amount of the emulsion breaker to be introduced can be reduced. That is, an effect of reducing the water content of the washed fuel oil and reducing the consumption of emulsion breaker can be attained in the present invention.

Some fuel oil contains less sludges, as in the bunker fuel oil B. In that case, pure water can be introduced into the fuel oil to make sludges, and the solid matters, sodium salt and potassium salt can be removed by removing the sludges.

Figure 8:
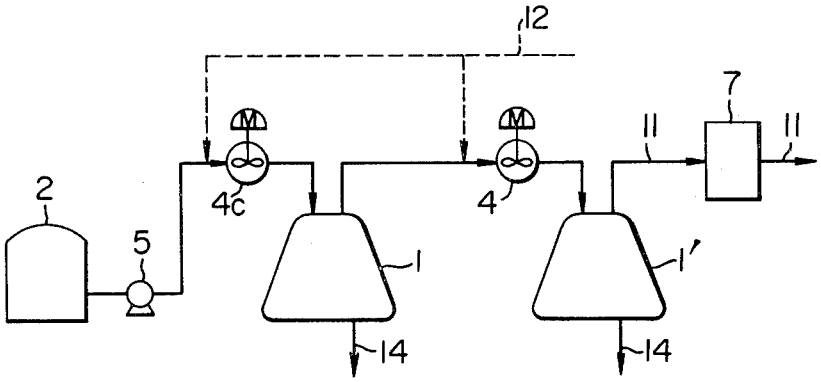

FIG. 8 shows still further embodiment of the present invention, where a mixer 4C is provided before the first centrifugal separator 1, so that pure water and raw fuel oil can be mixed before the just centrifugal separator 1. According to such a structure as shown in FIG. 8, pure water is dispersed in the raw fuel oil to form a group of water droplets, which is formed into a layer, that is, sludges in the first centrifugal separator 1, and solid matters, sodium salt and potassium salt can be removed by removing the sludges. According to the present invention, solid matters, sodium salt and potassium salt can be removed from the fuel oil even if the raw fuel oil contains no sludges.

Figure 9:
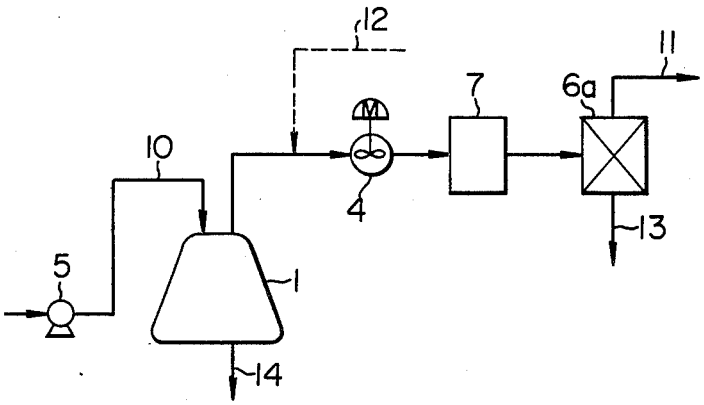

FIG. 9 shows still further embodiment of the present invention, where numeral 1 is a centrifugal separator, 5 is a pump for introducing the raw fuel oil from supply line 10 to the centrifugal separator, 4 is a mixer for mixing the fuel oil leaving the centrifugal separator 1 with pure water supplied through supply line 12, 7 is a filter, and 6a is an oil-water separating element for removing water from the fuel oil after the passage through the filter 7 to discharge it as waste water through discharge line 13, and simultaneously obtaining purified fuel oil to be supplied to a gas turbine (not shown in the drawing) through supply line 11.

The oil-water separating element 6a to be used in the present embodiment has a structure comprised of fibers in a cloth state or a rope state, as described before. Openings of the filter 7 have sizes of 5 μm, which are smaller than the sizes of openings of the oil-water separating element 6a.

In FIG. 9, the raw fuel oil is introduced into the centrifugal separator 1 by the pump 5, where the solid matters are removed from the fuel oil as sludges through the discharge line 14. In that case, no emulsion breaker is added to the fuel oil, and fine solid matters can be effectively removed from the water layer, without discharging them into the fuel oil, together with a portion of water having a larger specific gravity than that of the fuel oil. The fuel oil leaving the centrifugal separator 1 is admixed with pure water supplied from supply line 12, and mixed in the mixer 4 and led to the oil-water separating element 6a through the filter 7. The water used in the washing is separated in the oil-water separating element 6a, and discharged as waste water through the discharge line 13, whereas the fuel oil is led to a gas turbine as washed fuel oil through the supply line 11. The fuel oil to be led to the oil-fuel separating element 6a is effectively removed of fine solid matters in the centrifugal separator 1 and further by the filter 7 having smaller opening sizes, and thus the content of fine solid matters is much reduced.

Test results of desalting of fuel oil according to the foregoing embodiment will be described below, while comparing them with those of the prior art shown in FIG. 1.

Raw fuel oil containing 30 ppm Na and 5,000 ppm water is used, and 50 ppm of an emulsion breaker is added thereto. According to the prior art system, the resulting washed fuel oil has 0.9 ppm Na and 2,000 ppm water. On the other hand, according to the embodiment of the present invention, the washed fuel oil has 0.5 ppm Na, and 600 ppm water. Thus, the washing effect can be greatly improved, as compared with the prior art system, and pressure drop of filter 7 is only increased to less than 0.1 kg/cm$^2$ even after the operation for 70 hours, and can be kept at such a low value. Suppose that an allowable pressure drop for the operation is 1 kg/cm$^2$, it can be seen that a continued operation for over 700 hours is possible.

Furthermore, the apparatus cost of the oil-water separating element 6a is about one-fifth of that of the second centrifugal separator 1' used in FIG. 1, and thus the present invention can provide a cheap desalting apparatus.

Since almost all the fine solid matters can be removed in the centrifugal separator 1, use of the filter 7 may be not necessitated, but the cost of the filter 7 is about one-third of that of the oil-water separating element 6a, and thus an operating cost can be reduced by exchanging the filter 7 and thereby ensuring the continuous operation.

Kind of raw fuel oil is varied, and some fuel oil has a small Na content. In that case, almost all of the impurities such as Na, etc. can be removed in the centrifugal separator 1, and thus fuel oil can be treated without any addition of pure water. A portion of water containing some impurities in solution in the fuel oil is entrained in the fuel oil stream, and can be removed in the oil-water separating element 6a, whereby the impurities can be removed, that is, the desalting can be attained. According to tests, raw fuel oil containing 5 ppm Na can be reduced to 0.7 ppm Na in the resulting washed fuel oil. When no pure water is used as above, an apparatus for supplying water and purifying water can be unnecessitated, making the process economical, and particularly its effect is large where available water is less.

According to the foregoing embodiment, no water is added to fuel oil to be introduced into the centrifugal separator 1, but when the raw fuel oil has a smaller water content, flowing of the sludges from the centrifugal separator 1 becomes relatively difficult. In that case, as shown in an embodiment shown in FIG. 10, a portion or all of the water separated in the oil-water separating element 6a through discharge line 13 is added to the upstream side of the centrifugal separator 1 and mixed with the fuel oil in a mixer 4C, whereby a large number of water droplets can be formed in the raw fuel oil, and a flowability of the sludges can be improved owing to the water droplets in the sludges formed by the centrifugal force. That is, an effect of improving the flowability of sludges can be attained.

Figure 10:
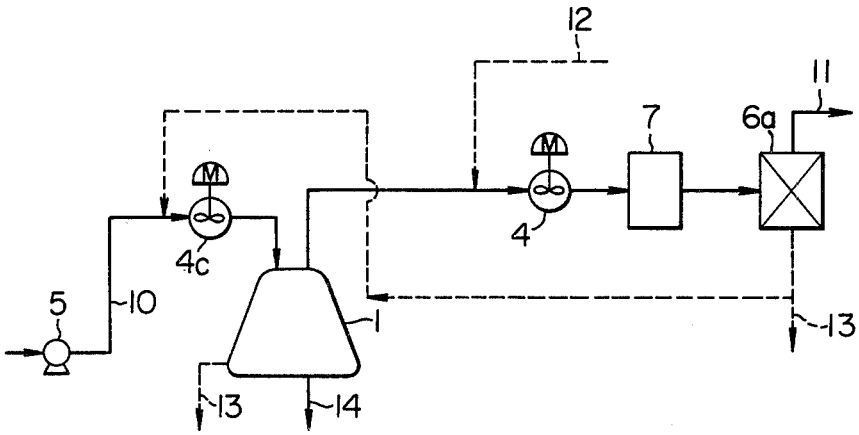

As shown in FIG. 10, a large number of water droplets are formed by adding washing water to the raw fuel oil to make an emulsion, and the oil-water separating element 6a can join the water droplets together to make the size of water droplets larger and separate the water. To promote the water dropletjoining action, an emulsion breaker is added from the supply line 15 to fuel oil between the centrifugal separator 1 and the filter 7, together with pure water supplied through the supply line 12, as shown in an embodiment of FIG. 11. The oil-separating action of the oil-water separating element 6a can be promoted by the addition of emulsion breaker, and an effect of reducing the water content of washed fuel oil can be attained thereby.

Figure 11:
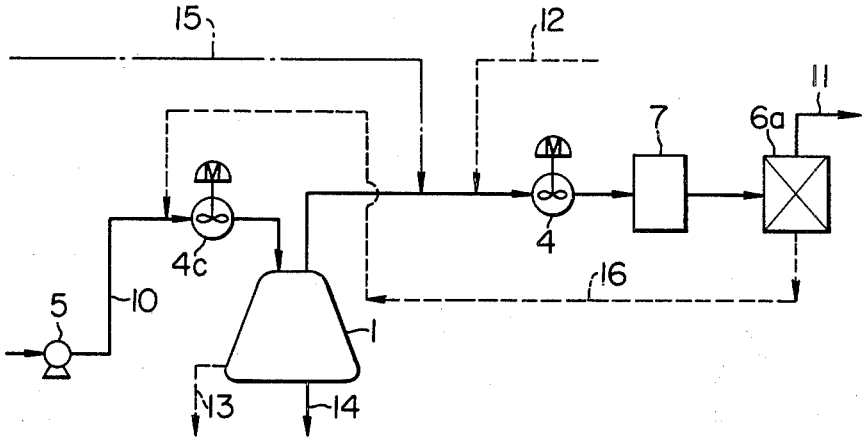

According to the embodiment of FIG. 11, washing water through the supply line 16 is added to fuel oil before the centrifugal separator 1, but such addition can be, of course, omitted, depending upon the kind of fuel oil. Even in that case, the effect of adding the emulsion breaker can be, of course, attained.

Organic solid matters contained in fuel oil melt at 40°–70° C., and are dissolved in fuel oil. Thus, when an operating temperature of the oil-water separating element 6a is lower than that of the centrifugal separator 1, depending upon the kind of fuel oil, the dissolved organic solid matters are liable to be deposited to cause clogging. In that case, a heater must be provided before the filter 7 to elevate the temperature of fuel oil above the operating temperaure of centrifugal separator 1. The organic solid matters entrained in the fuel oil after the centrifugal separator 1 can be dissolved by the heating operation, preventing deposition of the organic solid matters, and thus preventing the clogging of the filter 7 and the oil-water separating element 6*a*.

According to the embodiments shown in FIGS. 9 to 11, the reduction in the apparatus cost and the increase in the desalting effect can be attained, as described before. The operating cost of the foregoing embodiments will be compared below with that of the prior art system shown in FIG. 1.

Different from the prior art system where the emulsion breaker is introduced into the fuel oil at two locations before the first and second centrifugal separators 1 and 1', the emulsion breaker is added to the fuel oil at one location or not at all according to the present invention. According to the prior art system, 500 ppm of the emulsion breaker is added to the fuel oil at each of the two locations. Suppose that a treating rate of fuel oil is 100 $m^3$/hr, a rate of introducing the emulsion breaker will be 10 kg/hr and its cost will be ¥8,000/hr, because a unit cost of the emulsion breaker is about ¥800/kg. According to the test, exchange of the filter 7, if provided, is not required for a continued operation for 700 hours. At 700th hour, the cost of emulsion so far consumed according to the prior art system will amount to ¥5,600,000. On the other hand, the cost of element of filter 7 is about ¥700,000. Thus, the operating cost can be reduced to about one-eighth of that of the prior art system.

On the other hand, when no such filter 7 is provided, the oil-water separating element 6*a* must be exchanged, but the cost of the element is about ¥2,000,000. Thus, in that case, the operating cost can be reduced to about one-third of that of the prior art system. In any way, an important effect of greatly reducing the operating cost can be attained in the present invention.

Among the pure water used in the foregoing embodiments, about 200–700 ppm of it is entrained in the washed fuel oil. If the pure water contains sodium salt or potassium salt, the latter will contaminate the washed fuel oil, and thus it is desirable to use water containing not more than 1,000 ppm Na or K as pure water. The mixers 4 and 4C are directed to mixing of fuel oil with water, etc., and thus can be not of a stirrer structure. For example, mixing by a pump or an orifice is also possible.

The centrifugal separator used in the present invention will be described below.

Figure 12:
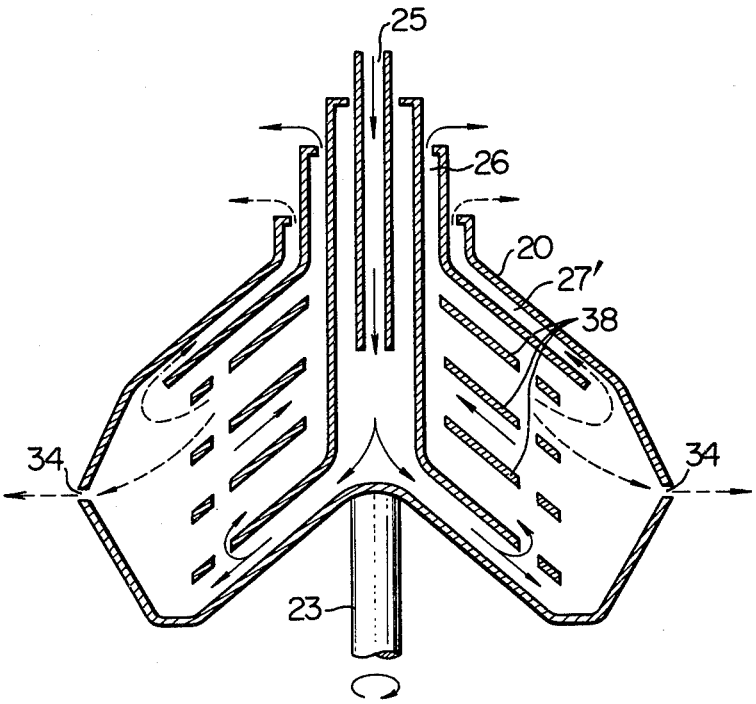
FIG. 12 is a cross-sectional view of a centrifugal separator.

A centrifugal separator shown in FIG. 12 is used in the prior art desalting of fuel oil, and also can be used in the present invention, where numeral 20 is a centrifugal separator body, 23 is a shaft, 25 is a raw fuel oil conduit, 26 is a treated oil conduit, 27' is a water conduit, 34 is sludge outlet holes, and 38 is vanes. The treated oil conduit 26, the water conduit 27', sludge outlet holes 34 and vanes 38 are rotated at an angular speed equal to that at which the shaft 23 rotates. The raw fuel oil conduit 25 is off from these members and will not rotate.

The fuel oil introduced through the raw fuel oil conduit 25 is guided to a bottom outermost peripheral side of the centrifugal separator 20, and entered into between the vanes 38 and given a rotating force by the wall of the centrifugal separator 20, vanes 38 in the separator, etc., and made to rotate. The vanes are conical plates, each of which is provided at a small clearance between them. The fuel oil entered into therebetween is given a centrifugal force by the revolution of fuel oil itself, and the fuel oil having a much smaller specific gravity moves inwardly in the separator, whereas the water and sludges having a larger specific gravity move outwardly therein, whereby the water and sludges are separated from the fuel oil. The fuel oil freed from the water and sludges passes through the treated fuel oil conduit 26 and ejected to the outside of the separator by a centrifugal force. A cover (not shown in the drawing), which is separated from the separator and is not rotatable, is provided outside the separator, and the ejected fuel oil is collected by the cover. On the other hand, the water and sludges are moved to the outermost peripheral side of the centrifugal separator 20, and the water having a low viscosity passes through the water conduit 27', and is ejected and collected in a water receptacle cover (not shown in the drawing) provided at the outside of the separator. Since the sludges are high in viscosity, they cannot pass through the water conduit 27', and are ejected through the sludge outlet holes 34 and collected by a sludge receptacle cover (not shown in the drawing). Both water receptacle cover and sludge receptacle cover are fixed, and are not rotated. The sludge outlet holes 34 are small holes, through which the sludges can pass under a high liquid pressure prevailing in the separator.

In the conventional type of separating the water and sludge from the fuel oil as described above, there is such a problem that the fuel oil enters into the water conduit 27', and ejected to the outside of the separator, reducing the amount of recovered fuel oil. That is, a liquid pressure is an integrated value of centrifugal forces possessed by the liquid from the innermost peripheral side toward the outermost peripheral side of the centrifugal separator body 20, and amounts to a highest pressure such as a few 10 kg/$cm^2$ at the outermost peripheral side. However, there is no water in the water conduit 27', and the pressure is almost zero therein. Thus, the fuel oil enters therein. The tip end of the water conduit 27' is throttled to reduce the amount of the fuel oil ejected therefrom (said fuel oil is a kind of mixture of fuel oil and water, because a small amount of water is also contained therein, but cannot be used as purified fuel oil) and to increase the amount of recovered fuel oil.

However, such a structure as described above has another problem in the sludge ejection from the sludge outlet holes 34. The sludges is so high in viscosity that it hardly flows, but the liquid pressure given to the sludge with the centrifugal separator body 20 is as high as a few 10 kg/$cm^2$, and thus a large amount of fuel oil passes even through small openings of the sludge outlet holes 34, and the fuel oil is also ejected therefrom. The size of the sludge outlet holes 34 can be adjusted, only when the rotation is stopped to discontinue the operation. When the rotation is stopped, the size is selected in view of the sludge content, viscosity, etc. However, clogging by solid matters at the sludge outlet holes 34, variation in the sludge content by the kind of fuel oil, etc. must be taken into account at the selection, and thus the selection is quite difficult to conduct. The change of the size has a disadvantage of discontinuing the operation. Thus, even if there are a change in the sludge content, inclusion of solid matters in the sludges, etc., a centrifugal separator capable of changing an opening ratio of the sludge outlet holes 34 or changing a liquid pressure applied on the sludges is required for smoothly withdrawing an appropriate amount of the sludges during the operation.

Figure 13:
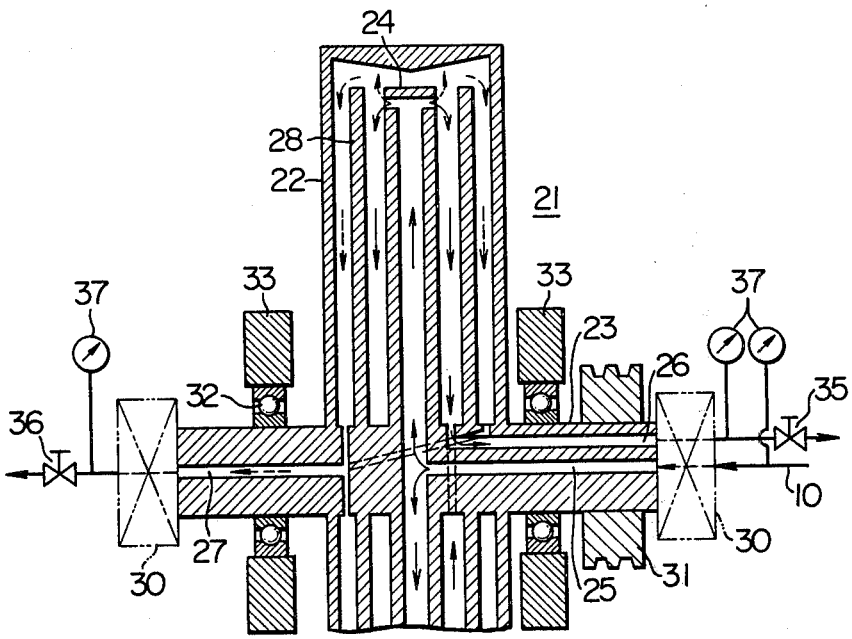
FIG. 13 is a cross-sectional view of a centrifugal extractor.
Figure 14:
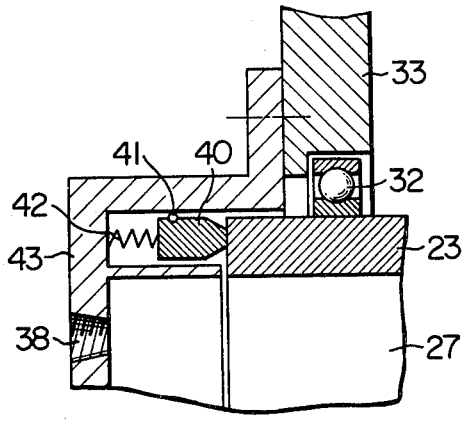
FIG. 14 is a cross-sectional view showing a detail of the structure in part of the centrifugal extractor shown in FIG. 13.

To meet the requirement, a centrifugal extractor as shown in FIGS. 13 and 14 is preferably used in the present invention, wherein numeral 21 is a centrifugal extractor, 22 is a rotor, 23 is a shaft, 24 is a liquid conduit, 25 is a fuel oil conduit, 26 is a treated fuel oil conduit, 27 is a sludge conduit, 28 is partition walls, 30 is a mechanical seal section, 31 is a pulley, 32 is bearings, 33 is frames, 35 is a back pressure valve, 36 is a sludge valve, 37 is pressure gages, 38 is a sludge outlet, 40 is a carbon ring, 41 is an O ring, 42 is a spring, and 43 is a cover.

Main members of the centrifugal extractor are the shaft 23, the rotor 22, the pulley provided at the shaft 23, and the mechanical seal section 30. The shaft 23 is fixed to the frames 33 through the bearings 32.

When the pulley 31 is given a rotating power by the driving action of a belt, the shaft 23 and the rotor 22 start to rotate. Since only the carbon ring 40 pressed by the spring 42 is in contact with the rotating shaft 23 at the mechanical seal section 30, rotation of the shaft 23, etc. can be smoothly made, though the cover 43 and the carbon ring 40 are fixed. Fuel oil, sludges, etc. can be passed through their specific conduits by the carbon ring 40 and the O ring 41, and are not mixed with one another. That is, the fuel oil, sludges, etc. can be introduced or withdrawn into the rotating shaft without being mixed with one another.

FIG. 14 shows a structure of mechanical seal, and a double system where the raw fuel oil can pass through the innermost peripheral side and the treated oil through the outermost peripheral side, or a triple system can be readily provided.

The raw fuel oil from the supply line 10 passes through the mechanical seal section 30, then the raw fuel oil conduit 25 as a hole provided through the shaft 23, and the liquid conduit 24 provided in the rotor 22 and enters into the rotor 22. The fuel oil is separated from the water and sludges in the rotor 22 under an action of a strong centrifugal force, and the fuel oil having a smaller specific gravity is moved toward the innermost peripheral side in the rotor and passes through the treated fuel oil conduit provided on the shaft 23, and through the mechanical seal section 30 and the back pressure valve 35, and is led to the outside. The water and sludges are moved toward the outermost peripheral side, and pass through clearances between the partition walls 28 comprised of disks vertically fixed to the shaft 23 and the side walls of the rotor 22 and reach the shaft, and then pass through the sludge conduit 27 as a hole through the shaft 23 and through the mechanical seal section 30 and the sludge valve 36, and led to the outside.

The mechanical seal can introduce or withdraw the liquid into or from the rotating member, as described above, and can be handled as one conduit without mixing the introduced liquid with the withdrawn liquid. That is, it is possible to apply a positive or negative pressure to these liquids. For example, the introducing pressure of raw fuel oil will be a sludge outlet pressure when the back pressure valve 35 is closed, and the sludges can be made to flow out under a strong pressure, whereas when the sludge valve 36 is closed, and the back pressure valve 35 is opened, the fuel oil can be made to flow out of the back pressure valve 35. Thus, an appropriate amount of the sludges can be withdrawn at an appropriate degree of opening of the back pressure valve 35 and the sludge valve 36 during the revolution of the rotor 22. Thus, a control can be made during the operation by adjusting the back pressure valve 35 and the sludge valve 36 through detection of the amounts of the withdrawn liquid or by observing pressure gages 37, because the pressures at the outlet and the inlet of the liquid show their respective pressures owing to a pressure balance in the rotating member. That is, an appropriate amount of the sludges can be withdrawn, and the removal of solid matters, sodium salt and potassium salt from the fuel oil can be made smoothly without any trouble.

The centrifugal extractor is in such a structure that a rotating member and a fixed member are in contact with each other at specific faces in the part of introducing or withdrawing the liquid into or from the rotating member. The centrifugal extractor having said structure is very effective for the removal of sludges in the desalting of fuel oil, and can be used without water without any trouble, though the absence of water is a serious trouble in the centrifugal separator.

When there is water, both water and sludges can be withdrawn from the sludge outlet, and can be easily separated into water and sludges by leaving the mixture at a standstill.

Figure 15:
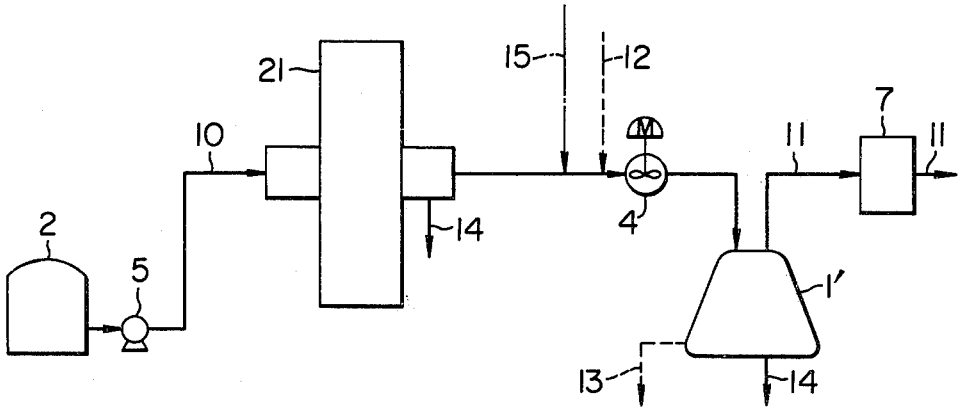
FIG. 15 is a block diagram showing another embodiment of the present process for desalting fuel oil using the centrifugal extractor shown in FIG. 13.

One embodiment of the present invention using said centrifugal extractor is given in FIG. 15, where a centrifugal extractor 21 of FIG. 13 is used in place of the first centrifugal separator 1 shown in FIG. 2, and neither water nor emulsion breaker is added to the raw fuel water to be introduced into the centrifugal extractor 21. According to the arrangement as shown in FIG. 15, the sludges as well as most of the sodium salt and potassium salt can be removed from the raw fuel oil in the centrifugal extractor 21. Purified washed fuel oil can be obtained from the centrifugal separator 1' by mixing pure water from the supply line 12 and the emulsion breaker from the supply line 15, followed by washing and separation as described before. That is, the solid matters can be removed together with the discharge of sludge, and no clogging takes place at the filter 7. A stable operation for a prolonged time is assured thereby.

According to the tests of the foregoing embodiment shown in FIG. 15, no solid matters having sizes of more than 5 μm are not observed in the fuel oil from the centrifugal extractor 21 and it is confirmed that the present invention is effective for the purification of fuel oil. In order to reduce the sodium salt and potassium salt content of fuel oil to less than 1 ppm, at least two centrifugal separating means are required, because a small amount of water droplets containing much sodium salt and potassium salt is entrained in the treated fuel oil stream, as described before. The pure water from the supply line 12 is the ordinary water, but since 500–3,000 ppm of the water is entrained in the treated fuel oil, it is desirable to use pure water containing not more than 1,000 ppm of sodium salt and potassium salt.

In the embodiment of FIG. 15, the centrifugal separator 1' can be the centrifugal extractor of such type as shown by 21 in place of the conventional centrifugal separator. Use of the centrifugal extractor for the centrifugal separator 1' is more advantages because of unification of parts to be exchanged.

As described in the foregoing, the present invention can remove the solid matters and salts from fuel oil at the same time very effectively with a reduced frequency of cleaning the filter, or by omitting the use of the filter, with or without using an emulsion breaker.

What is claimed is:

1. A process for desalting fuel oil, which comprises a separation step of separating fuel oil containing sludges into fuel oil and sludges, without the addition of an emulsion breaker, by a centrifugal separating means, thereby removing the sludges from the fuel oil, and a washing by mixing-separation step of mixing the fuel oil freed from the sludges with water and separating the resulting liquid mixture into fuel oil and water.

2. A process according to claim 1, wherein a centrifugal separating means is used in the washing by mixing-separation step.

3. A process according to claim 2, wherein a plurality of the washing by mixing-separation step is provided.

4. A process according to claim 3, wherein an emulsion breaker is added to a final stage of the plurality of the washing by mixing-separation step.

5. A process according to claim 1, wherein an oil-water separating element is used in the washing by mixing-separation step.

6. A process according to claim 5, wherein a temperature of the fuel oil in the washing by mixing-separation step is made higher than a temperature of the fuel oil in the separation step.

7. A process according to claim 1, 2 or 5, wherein a centrifugal separator is used as the centrifugal separating means.

8. A process according to claim 1, 2, or 5, wherein a centrifugal extractor is used as the centrifugal separating means.

9. A process according to claim 1, 2, 3 or 5, wherein an emulsion breaker is added to the washing by mixing-separation step.

10. A process according to claim 1, 2, 3 or 5, wherein the fuel oil is mixed with water, thereby forming an emulsion, and forming sludges in the fuel oil.

11. A process according to claim 1, wherein said sludges comprise a group of fine water droplets which are separable from the fuel oil by settling and said fuel oil also containing a salt of potassium and/or sodium and small particles of solid matter, a portion of the salt and of said solid matter being removed with the sludges during the separation step.

12. A process according to claim 11, wherein said fine water particles have a diameter of less than 10–50$\mu$.

13. A process according to claim 1, wherein said fuel oil containing sludges comprises raw fuel oil free of an emulsion breaker.

14. A process according to claim 1, wherein said fuel oil also contains a salt of sodium and/or potassium and small particles of solid matter, said solid matter being removed with the sludges during the separation step by the centrifugal separating means and the salt being removed by washing with water in the mixing-separation step.

* * * * *